US011905571B2

(12) United States Patent
Jung et al.

(10) Patent No.: US 11,905,571 B2
(45) Date of Patent: Feb. 20, 2024

(54) WIRE ROD FOR COLD HEADING, PROCESSED PRODUCT USING SAME, AND MANUFACTURING METHODS THEREFOR

(71) Applicant: POSCO, Pohang-si (KR)

(72) Inventors: Byung-In Jung, Pohang-si (KR); Sang-Yoon Lee, Pohang-si (KR); Han Hwi Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 355 days.

(21) Appl. No.: 17/270,956

(22) PCT Filed: Aug. 29, 2019

(86) PCT No.: PCT/KR2019/011086
§ 371 (c)(1),
(2) Date: Feb. 24, 2021

(87) PCT Pub. No.: WO2020/046016
PCT Pub. Date: Mar. 5, 2020

(65) Prior Publication Data

US 2021/0324493 A1 Oct. 21, 2021

(30) Foreign Application Priority Data

Aug. 31, 2018 (KR) ..... 10-2018-0103507

(51) Int. Cl.

| | |
|---|---|
| ***C21D 9/52*** | (2006.01) |
| ***C21D 8/06*** | (2006.01) |
| ***C21D 6/00*** | (2006.01) |
| ***C22C 38/24*** | (2006.01) |
| ***C22C 38/22*** | (2006.01) |
| ***C22C 38/04*** | (2006.01) |
| ***C22C 38/02*** | (2006.01) |
| ***B21B 1/16*** | (2006.01) |
| ***B21B 37/74*** | (2006.01) |
| ***B21B 3/02*** | (2006.01) |

(52) U.S. Cl.

CPC ..... *C21D 9/525* (2013.01); *B21B 1/16* (2013.01); *B21B 3/02* (2013.01); *B21B 37/74* (2013.01); *C21D 6/002* (2013.01); *C21D 6/005* (2013.01); *C21D 6/008* (2013.01); *C21D 8/065* (2013.01); *C22C 38/02* (2013.01); *C22C 38/04* (2013.01); *C22C 38/22* (2013.01); *C22C 38/24* (2013.01); *C21D 2211/001* (2013.01); *C21D 2211/002* (2013.01); *C21D 2211/008* (2013.01); *C21D 2211/009* (2013.01)

(58) Field of Classification Search

CPC .... B21B 1/16; B21B 3/00; B21B 3/02; B21B 37/74; C21D 1/18; C21D 2211/001; C21D 2211/002; C21D 2211/008; C21D 2211/009; C21D 6/002; C21D 6/005; C21D 6/008; C21D 8/065; C21D 9/52; C21D 9/525; C22C 38/02; C22C 38/04; C22C 38/12; C22C 38/22; C22C 38/24

See application file for complete search history.

(56) References Cited

U.S. PATENT DOCUMENTS

2005/0217763 A1* 10/2005 Ahn ..... C22C 38/02 420/105
2007/0256767 A1* 11/2007 Ahn ..... C22C 38/44 420/8

FOREIGN PATENT DOCUMENTS

| | | | | |
|---|---|---|---|---|
| CN | 1668773 | A | | 9/2005 |
| CN | 107794441 | A | | 3/2018 |
| JP | H06-306543 | A | | 11/1994 |
| JP | H09-287056 | A | | 11/1997 |
| JP | 2731797 | B2 | | 3/1998 |
| JP | 2002241899 | A | * | 8/2002 |
| KR | 10-2001-0064845 | A | | 7/2001 |
| KR | 10-2004-0006248 | A | | 1/2004 |
| KR | 10-2010-0050037 | A | | 5/2010 |
| KR | 10-2016-0066570 | A | | 6/2016 |
| KR | 10-2090224 | B1 | | 3/2020 |
| KR | 10-2020-0076540 | A | | 6/2020 |
| WO | 2005/059192 | A1 | | 6/2005 |
| WO | 2007/074986 | A1 | | 7/2007 |

OTHER PUBLICATIONS

Carbon Steel Wikipedia (Year: 2017).*
Extended European Search Report dated May 18, 2021 issued in European Patent Application No. 19856104.5.
Chinese Office Action dated Mar. 11, 2022 issued in Chinese Patent Application No. 201980060544.8 (with English translation).
Chinese Office Action dated Jul. 1, 2022 issued in Chinese Patent Application No. 201980060544.8 (with English translation).
International Search Report dated Dec. 20, 2019 issued in International Patent Application No. PCT/KR2019/011086 (with English translation).
Korean Notice of Allowance dated Feb. 26, 2020 issued in Korean Patent Application No. 10-2018-0103507.
Korean Office Action dated Sep. 23, 2019 issued in Korean Patent Application No. 10-2018-0103507.
Chinese Office Action dated Sep. 3, 20201 issued in Chinese Patent Application No. 201980060544.8 (with English translation).

* cited by examiner

*Primary Examiner* — Jenny R Wu
(74) *Attorney, Agent, or Firm* — Morgan, Lewis & Bockius LLP

(57) ABSTRACT

The present disclosure relates to a CHQ wire rod that has improved resistance to hydrogen delayed fracture while securing cold forging characteristics by reducing Si content and adding Mo and V, a processed product using the same, and a manufacturing method thereof. In accordance with an aspect of the present disclosure, a CHQ wire rod includes, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and the value of the following formula (1) is 3.56 or more.

5 Claims, 2 Drawing Sheets

【FIG. 1】
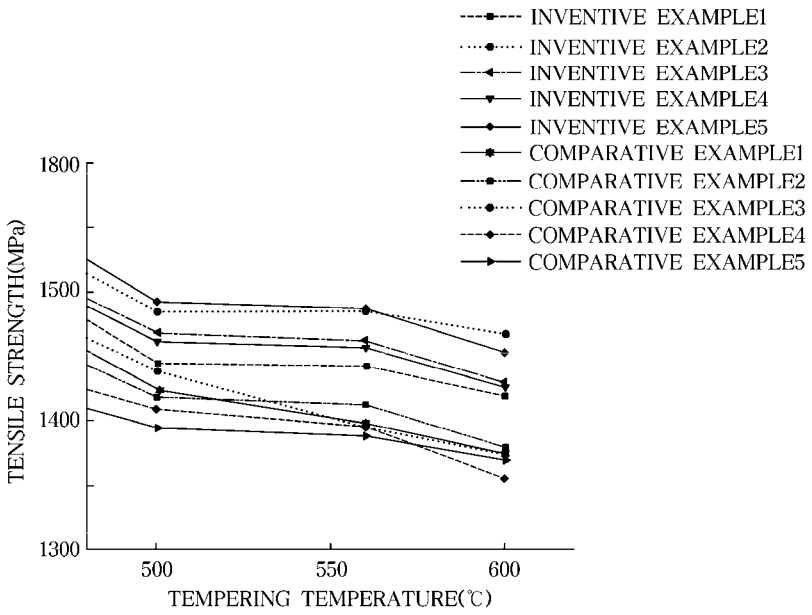

【FIG. 2】
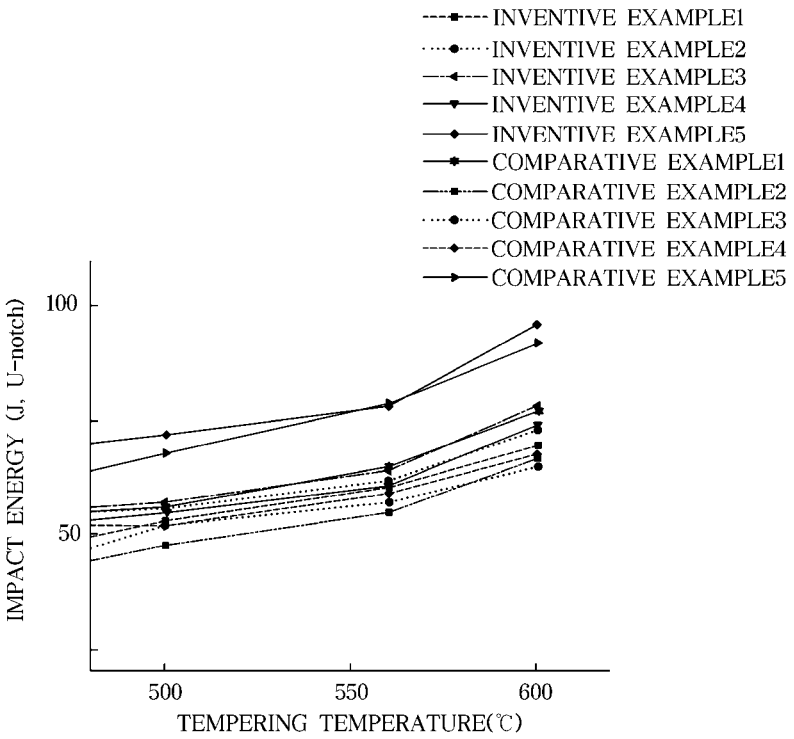

WIRE ROD FOR COLD HEADING, PROCESSED PRODUCT USING SAME, AND MANUFACTURING METHODS THEREFOR

CROSS-REFERENCE OF RELATED APPLICATIONS

This application is the U.S. National Phase under 35 U.S.C. § 371 of International Patent Application No. PCT/KR2019/011086, filed on Aug. 29, 2019, which in turn claims the benefit of Korean Application No. 10-2018-0103507, filed on Aug. 31, 2018, the entire disclosures of which applications are incorporated by reference herein.

TECHNICAL FIELD

The present disclosure relates to a Cold Heading Quality (CHQ) wire rod, a processed product using the same, and a manufacturing method thereof, and more particularly, to a CHQ wire rod having improved resistance to hydrogen delayed fracture while securing cold forging characteristics, a processed product using the same, and a manufacturing method thereof.

BACKGROUND ART

General CHQ wire rod products are manufactured into mechanical structures and automobile parts through wire rod, cold drawing, spheroidizing heat treatment, cold drawing, cold heading, quenching and tempering.

The recent technology development trend of cold heading products is focused on the development of high-strength cold heading products that can achieve weight reduction in parts to respond to global automobile fuel economy regulations along with process-omitted wires that omit heat treatment and processing. For example, in order to respond to global automobile fuel economy regulations to improve the atmospheric environment, vehicle weight reduction is in progress, and for this purpose, parts such as engines are miniaturized and high-powered. In order to manufacture such a miniaturized and high-powered component, a high-strength cold heading product is required.

This high-strength cold heading processed product undergoes rapid cooling and tempering heat treatment after cold heading, and the tempered martensite structure, which is a microstructure formed at this time, is very sensitive to hydrogen delayed fracture at high strength of 1300 MPa or more, and is difficult to use. Therefore, it is necessary to develop a wire rod having cold forging characteristics and improved resistance to hydrogen delayed fracture, and a processed product using the same.

DISCLOSURE

Technical Problem

The present disclosure intends to provide a CHQ wire rod with improved resistance to hydrogen delayed fracture without impairing cold forging characteristics, a processed product using the same, and a manufacturing method thereof.

Technical Solution

In accordance with an aspect of the present disclosure, a CHQ wire rod includes, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and the value of the following formula (1) is 3.56 or more.

$$[Cr]+2.7*[Mo]+6*[V] \quad (1)$$

Here, [Cr], [Mo], and [V] mean the weight % of Cr, Mo, and V, respectively.

The wire rod may include a bainite, a martensite, and a pearlite as a microstructure, and, in area fraction, the bainite may be 85% or more, the martensite may be 2 to 10%, and the pearlite may be 1 to 5%.

The average austenite grain size of the wire rod may be 30 μm or less.

In accordance with another aspect of the present disclosure, a processed product includes, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and the value of the following formula (1) is 3.56 or more.

$$[Cr]+2.7*[Mo]+6*[V] \quad (1)$$

The processed product may include a tempered martensite as a microstructure.

The tensile strength of the processed product may be 1400 MPa or more, and impact toughness of the processed product may be 50 J or more.

In accordance with another aspect of the present disclosure, a manufacturing method of a CHQ wire rod includes: heating a billet comprising, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and having a value of 3.56 or more in the following formula (1), at 900 to 1200° C., finishing rolling the heated billet at 850 to 1150° C.; and controlling the average austenite grain size to be 30 μm or less by cooling the rolled billet at a rate of 0.2 to 0.5° C./s.

$$[Cr]+2.7*[Mo]+6*[V] \quad (1)$$

In accordance with another aspect of the present disclosure, a manufacturing method of a processed product further include: heating the CHQ wire rod at 850 to 1050° C.; cooling the heated wire rod to 40 to 70° C.; and heating the cooled wire rod at 500 to 600° C. for 5000 to 10000 seconds.

Advantageous Effects

The CHQ wire rod according to an embodiment of the present disclosure, a processed product using the same, and a manufacturing method thereof can provide a wire rod with improved resistance to hydrogen delayed fracture while securing cold forging characteristics and a processed product using the same.

DESCRIPTION OF DRAWINGS

FIG. 1 is a graph measuring tensile strength according to a tempering temperature of Inventive Examples and Comparative Examples of the present disclosure.

FIG. 2 is a graph measuring the impact toughness according to the tempering temperature of Inventive Examples and Comparative Examples of the present disclosure.

BEST MODE

In accordance with an aspect of the present disclosure, a CHQ wire rod includes, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and the value of the following formula (1) is 3.56 or more.

$$[Cr]+2.7*[Mo]+6*[V] \quad (1)$$

(Here, [Cr], [Mo], and [V] mean the weight % of Cr, Mo, and V, respectively.)

Modes of the Invention

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

In accordance with an aspect of the present disclosure, a CHQ wire rod includes, in percent (%) by weight of the entire composition, C: 0.3 to 0.5%, Si: 0.1 to 0.3%, Mn: 0.5 to 1.0%, at least two or more of Cr: 0.5 to 1.5%, Mo: 0.5 to 1.5%, V: 0.01 to 0.2%, the remainder of iron (Fe) and other inevitable impurities, and the value of the following formula (1) is 3.56 or more.

$$[Cr]+2.7*[Mo]+6*[V] \quad (1)$$

(Here, [Cr], [Mo], and [V] mean the weight % of Cr, Mo, and V, respectively.)

Hereinafter, the role and content of each component included in the CHQ wire rod and processed product using the same according to the present disclosure will be described as follows. The percentages for the following components mean weight percent.

The content of C (carbon) is 0.3 to 0.5%.

C is an element added to ensure the strength of the product. If the C content is less than 0.3%, it is difficult to secure the target strength, and it is not easy to secure sufficient hardenability after quenching and tempering heat treatment. On the contrary, if the C content exceeds 0.5%, the fatigue life may be reduced due to excessive generation of carbides. Therefore, the upper limit is set at 0.5%. Accordingly, according to an embodiment of the present disclosure, the content of C is set to 0.3 to 0.5%.

The content of Si (silicon) is 0.1 to 0.3%.

Si is not only used for deoxidation of steel, but is also an element advantageous in securing strength through solid solution strengthening. Accordingly, 0.1% or more is added. However, the upper limit is limited to 0.3% because processing is difficult when excessively added. Accordingly, according to an embodiment of the present disclosure, the content of Si is 0.1 to 0.3%.

The content of Mn (manganese) is 0.5 to 1.0%.

Mn is advantageous in securing strength by improving the hardenability of the processed product, and is an element that increases rollability and reduces brittleness. To ensure sufficient strength, 0.5% or more is added. However, if excessively added, a hardened structure is likely to occur during cooling after hot rolling, and a large amount of MnS inclusions may be generated, resulting in a decrease in fatigue properties. Therefore, the upper limit is limited to 1.0%. Accordingly, according to an embodiment of the present disclosure, the content of Mn is set to 0.5 to 1.0%.

Further, according to an embodiment of the present disclosure, at least two or more of Cr: 0.5 to 1.5%, Mo: 0.5 to 1.5%, and V: 0.01 to 0.2% are included.

Cr, together with Mn, is effective for improving hardenability and is an element that improves the corrosion resistance of steel. Therefore, when adding, 0.5% or more is added. However, if Cr is added over a certain level, the impact toughness decreases, and since carbides that are inferior to hydrogen delayed fracture resistance are formed, the upper limit is limited to 1.5%.

Mo is an element that improves hardenability through precipitation strengthening and solid solution strengthening by precipitation of fine carbides. The improvement of hardenability due to Mo is more effective than Mn and Cr. When Mo is added, if the content is less than 0.5%, sufficient hardening is not performed, so it is not easy to secure sufficient strength after quenching and tempering heat treatment. On the contrary, when Mo is added in excess of 1.5%, the shape of the processed product may be distorted after quenching due to the excessively high hardenability. Therefore, there is a problem that requires an additional process to correct this, and the upper limit is set to 1.5%. When Mo is added, the content is set to 0.5 to 1.5%.

V is an element that refines the structure of steel by forming fine carbides such as VC, VN, and V(C, N). When V is added, if the content is less than 0.01%, the distribution of V precipitates in the base metal is small, so that the austenite grain boundary cannot be fixed. Therefore, the grains become coarse during tempering in the heat treatment process, resulting in a decrease in strength. When V is added, 0.01% or more is added. Conversely, when V is excessively added, coarse carbonitrides are formed, which lowers toughness, and the upper limit is limited to 0.2%. Accordingly, according to an embodiment of the present disclosure, when V is added, the content is set to 0.01 to 0.2%.

The value of the following formula (1) is 3.56 or more.

$$[Cr]+2.7*[Mo]+6*[V] \quad (1)$$

In order to improve resistance to hydrogen delayed fracture, it is necessary to obtain fine carbides capable of trapping diffusible hydrogen. Micro carbides capable of trapping hydrogen include CrC, MoC, and VC carbides, each of which is mainly composed of Cr, Mo, and V. When these carbides are present in a certain number or more, the strength of 1400 MPa or more can be secured at a tempering temperature of 500 to 600° C. and a hydrogen trap effect can be maximized. In particular, by controlling the value of formula (1), which is a combination of the contents of Cr, Mo, and V, to be 3.56 or more, it is possible to increase the strength of the cold heading steel and improve resistance to hydrogen delayed fracture.

The CHQ wire rod according to an embodiment of the present disclosure has a microstructure, including bainite, martensite, and pearlite, and in area fraction, bainite is 85% or more, martensite is 2 to 10%, and pearlite is 1 to 5%.

In addition, according to an embodiment of the present disclosure, the average austenite grain size may be 30 μm or less.

In addition, the processed product according to an embodiment of the present disclosure may include tempered martensite.

In addition, the tensile strength of the processed product according to an embodiment of the present disclosure may be 1400 MPa or more, and impact toughness of the processed product may be 50 J or more.

Hereinafter, a CHQ wire rod according to an embodiment of the present disclosure and a manufacturing method of a processed product using the same will be described.

The billet that satisfies the above-described component is heated. Heating of the billet proceeds at 900 to 1200° C.

The heated billet is finish-rolled at 850 to 1150° C. The billet can be wound after rolling. The rolling ratio may be 80% or more.

The rolled billet is cooled at a rate of 0.2 to 0.5° C./s, and the average austenite grain size is controlled to be 30 μm or less. Cooling can proceed with air cooling. After cooling, the microstructure of the wire rod contains bainite, martensite, and pearlite, and contains, in area fraction, bainite contains 85% or more, martensite 2 to 10%, and pearlite contains 1 to 5%.

Then, the cooled wire rod is heated at 850 to 1050° C. The heating time may be 3000 to 4000 seconds.

The heated wire rod is cooled to 40 to 70° C., that is, quenched. Cooling can be done by immersing in oil.

The cooled wire rod is heated at 500 to 600° C. for 5000 to 10000 seconds, that is, tempered. After tempering, the microstructure of the processed product may consist of tempered martensite. Since it is tempered at a high temperature of 500° C. or higher, it prevents the formation of thin film-like carbides of austenite grain boundaries, and spheroidized carbides are dispersed and distributed inside and outside the grain boundaries. This can improve the resistance to hydrogen delayed fracture of the processed product.

Hereinafter, the present disclosure will be described in detail through examples, but the following examples are for illustrating the present disclosure in more detail, and the scope of the present disclosure is not limited to these examples.

Inventive Example

The billet having the composition of the following [Table 1] was heated to 900 to 1200° C., hot rolling was performed with a finishing temperature of 1000° C. and a rolling ratio of 80% or more. After that, air cooling was performed at a cooling rate of 0.2 to 0.5° C./s. After processing the hot-rolled wire rod into a tensile specimen in accordance with ASTM E8 standard, it is heated at 920° C. for 3600 seconds, then immersed in 50° C. oil for rapid cooling, and then tempered at 500 to 600° C. for 5000 to 10000 seconds. And then, a tensile test was performed. The tensile test results of Comparative Examples 1 to 5 and Inventive Examples 1 to 5 are shown in FIG. 1.

TABLE 1

| | Alloy composition (wt %) | | | | | | [Cr] + 2.7*[Mo] + |
|---|---|---|---|---|---|---|---|
| | C | Si | Mn | Cr | Mo | V | 6*[V] |
| Inventive Example1 | 0.38 | 0.13 | 0.52 | 1.22 | 0.64 | 0.12 | 3.668 |
| Inventive Example2 | 0.47 | 0.25 | 0.89 | 1.02 | 0.85 | 0.05 | 3.615 |
| Inventive Example3 | 0.42 | 0.22 | 0.73 | 0.83 | 0.82 | 0.09 | 3.584 |
| Inventive Example4 | 0.43 | 0.27 | 0.91 | 0.98 | 0.54 | 0.19 | 3.578 |
| Inventive Example5 | 0.32 | 0.23 | 0.52 | 0.57 | 1.47 | 0.15 | 5.439 |
| Comparative Example1 | 0.39 | 0.12 | 0.54 | 1.01 | 0.65 | 0.11 | 3.425 |

TABLE 1-continued

| | Alloy composition (wt %) | | | | | | [Cr] + 2.7*[Mo] + |
|---|---|---|---|---|---|---|---|
| | C | Si | Mn | Cr | Mo | V | 6*[V] |
| Comparative Example2 | 0.46 | 0.26 | 0.87 | 0.93 | 0.86 | 0.03 | 3.432 |
| Comparative Example3 | 0.42 | 0.23 | 0.71 | 0.87 | 0.72 | 0.09 | 3.354 |
| Comparative Example4 | 0.42 | 0.25 | 0.83 | 0.96 | 0.55 | 0.15 | 3.345 |
| Comparative Example5 | 0.33 | 0.24 | 0.53 | 0.53 | 1.08 | 0.01 | 3.506 |

As can be seen from [Table 1], the values of formula (1) in Inventive Examples 1 to 5 according to the present disclosure are all 3.56 or more, but the values of formula (1) in Comparative Example 1 to Comparative Example 5 according to Comparative Example of the present disclosure are all less than 3.56.

In addition, referring to the tensile test results shown in FIG. 1, Inventive Example 1 to Inventive Example 5 all show tensile strength of 1400 MPa or more, but in Comparative Example 1 to Comparative Example 5, it can be seen that the tensile strength decreased around 600° C. and thus the tensile strength was less than 1400 MPa.

In addition, referring to the impact toughness results shown in FIG. 2, it can be seen that Inventive Example 1 to Inventive Example 5 all have impact toughness of 50 J or more.

Thus, according to the Inventive Example of the present disclosure, the cold forging characteristics can be secured by minimizing the content of Si, which causes solid solution strengthening and inhibiting cold forging characteristics, adding Mo to prevent strength reduction, and adding V to increase strength and refine grains. In addition, at the same time, it is possible to improve resistance to hydrogen delayed fracture by tempering heat treatment at a high temperature of 500° C. or more, and by adding V to refine crystal grains. Accordingly, the processed product may have a tensile strength of 1400 Mpa or more and an impact toughness of 50 J or more.

As described above, although exemplary embodiments of the present disclosure have been described, the present disclosure is not limited thereto, and those of ordinary skill in the art will appreciate that various changes and modifications are possible without departing from the concept and scope of the following claims.

INDUSTRIAL APPLICABILITY

The CHQ wire rod and processed product according to the present disclosure provide 1.4 GPa high-strength CHQ steel with cold forging characteristics and resistance to hydrogen delayed fracture at the same time and can be used as automotive parts.

The invention claimed is:

1. A CHQ wire rod comprising, in percent (%) by weight of the entire composition, C: 0.3 to 0.5%, Si: 0.1 to 0.3%, Mn: 0.5 to 1.0%, Cr: 0.5 to 1.5%, Mo: 0.5 to 1.5%, V: 0.01 to 0.2%, the remainder of iron (Fe) and other inevitable impurities, and the value of the following formula (1) is 3.56 or more;

$$[Cr]+2.7*[Mo]+6*[V] \quad (1)$$

(Here, [Cr], [Mo], and [V] mean the weight % of Cr, Mo, and V, respectively)

wherein the wire rod comprises a bainite, a martensite, and a pearlite as a microstructure, and in area fraction, the bainite is 85% or more, the martensite is 2 to 10%, and the pearlite is 1 to 5%.

2. The CHQ wire rod according to claim 1, wherein the average austenite grain size of the wire rod is 30 μm or less.

3. A manufacturing method of a CHQ wire rod according to claim 1, the method comprising:

heating a billet comprising, in percent (%) by weight of the entire composition, C: 0.3 to 0.5%, Si: 0.1 to 0.3%, Mn: 0.5 to 1.0%, Cr: 0.5 to 1.5%, Mo: 0.5 to 1.5%, V: 0.01 to 0.2%, the remainder of iron (Fe) and other inevitable impurities, and having a value of 3.56 or more in the following formula (1), at 900 to 1200° C.;

finishing rolling the heated billet at 850 to 1150° C.;

controlling the average austenite grain size to be 30 μm or less by cooling the rolled billet at rate of 0.2 to 0.5° C./s;

$$[Cr]+2.7*[Mo]+6*[V] \quad (1)$$

(Here, [Cr], [Mo], and [V] mean the weight % of Cr, Mo, and V, respectively)

thereby producing the CHQ wire rod of claim 1.

4. A manufacturing method of a processed product according to claim 3, the method further comprises:

heating the CHQ wire rod at 850 to 1050° C.;

cooling the heated wire rod to 40 to 70° C.; and heating the cooled wire rod at 500 to 600° C. for 5000 to 10000 seconds.

5. A manufacturing method of a CHQ wire rod according to claim 2, the method comprising:

heating a billet comprising, in percent (%) by weight of the entire composition, C: 0.3 to 0.5%, Si: 0.1 to 0.3%, Mn: 0.5 to 1.0%, Cr: 0.5 to 1.5%, Mo: 0.5 to 1.5%, V: 0.01 to 0.2%, the remainder of iron (Fe) and other inevitable impurities, and having a value of 3.56 or more in the following formula (1), at 900 to 1200° C.;

finishing rolling the heated billet at 850 to 1150° C.;

controlling the average austenite grain size to be 30 μm or less by cooling the rolled billet at rate of 0.2 to 0.5° C./s;

$$[Cr]+2.7*[Mo]+6*[V] \quad (1)$$

(Here, [Cr], [Mo], and [V] mean the weight % of Cr, Mo, and V, respectively)

thereby producing the CHQ wire rod of claim 2.

* * * * *